US008136753B2

(12) United States Patent
Galgano et al.

(10) Patent No.: US 8,136,753 B2
(45) Date of Patent: Mar. 20, 2012

(54) TRANSPORTER FOR BOX OF SPOOLED WIRE OR CABLE

(75) Inventors: Richard Galgano, Naperville, IL (US); Mark K. Winkel, Indian Head Park, IL (US); Martin J. McGuire, Downers Grove, IL (US)

(73) Assignee: Windy City Wire Cable and Technology Products, LLC, Bolingbrook, IL (US)

( * ) Notice: Subject to any disclaimer, the term of this patent is extended or adjusted under 35 U.S.C. 154(b) by 392 days.

(21) Appl. No.: 12/547,216

(22) Filed: Aug. 25, 2009

(65) Prior Publication Data

US 2011/0048992 A1 Mar. 3, 2011

(51) Int. Cl.
*B65D 85/04* (2006.01)
*B65H 49/20* (2006.01)

(52) U.S. Cl. ..... 242/578.2; 242/588.2; 242/588.6; 242/598.1; 242/598.5; 242/599.1; 242/129; 242/129.6; 294/16

(58) Field of Classification Search ..... 242/170, 242/578, 578.2, 588, 588.1, 588.2, 588.3, 242/588.6, 596, 596.1, 596.4, 596.8, 598, 242/598.1, 598.3, 598.4, 598.5, 599, 599.1, 242/128, 129, 129.6; 294/16, 34, 62; 211/85.4, 211/85.17, 51, 175, 119.009, 182; 248/121
See application file for complete search history.

(56) References Cited

U.S. PATENT DOCUMENTS

| | | | | |
|---|---|---|---|---|
| 300,813 | A * | 6/1884 | Stewart | 294/16 |
| 1,341,484 | A * | 5/1920 | Starratt | 242/588.2 |
| 3,412,847 | A | 11/1968 | Wise et al. | |
| 3,854,509 | A | 12/1974 | Bailey | |
| 4,367,853 | A | 1/1983 | Kotzur | |
| 4,406,419 | A | 9/1983 | Kotzur | |
| 4,477,033 | A | 10/1984 | Kotzur et al. | |
| 4,741,495 | A | 5/1988 | Kotzur | |
| 4,811,918 | A * | 3/1989 | Grooms | 242/419 |
| 5,222,683 | A | 6/1993 | Blackshire | |
| 5,529,186 | A | 6/1996 | Bass | |
| 5,551,647 | A | 9/1996 | Browning | |
| 5,704,479 | A | 1/1998 | Barnett et al. | |
| 5,775,621 | A | 7/1998 | Sauber | |
| 5,967,451 | A | 10/1999 | Radaios | |
| 6,003,667 | A | 12/1999 | Barnett et al. | |
| 6,234,421 | B1 | 5/2001 | Cox et al. | |
| 6,523,777 | B2 | 2/2003 | Gaudio | |
| 7,204,452 | B2 | 4/2007 | Wilkinson et al. | |
| 2003/0080011 | A1 | 5/2003 | You et al. | |
| 2005/0035240 | A1 | 2/2005 | Weck et al. | |

(Continued)

OTHER PUBLICATIONS

Wire Caddy, Cable Reel Stands—Quick Spooler, downloaded from http://www.quickspooler.com/ on Jul. 14, 2009.

(Continued)

*Primary Examiner* — William E Dondero
(74) *Attorney, Agent, or Firm* — Momkus McCluskey, LLC; Jefferson Perkins; Steven Behnken

(57) ABSTRACT

Apparatus for manually transporting cartons or reels of goods include a support structure that includes a horizontal support member having first and second components, first and second vertical support members, and first and second bushings attached to the vertical support members for insertion into arbor holes in a reel or carton. Additionally, the apparatus includes a handle affixed to the support structure. In an alternate embodiment, one or more stabilization members prevent the carton from rotating as the contents of the carton are removed.

24 Claims, 5 Drawing Sheets

U.S. PATENT DOCUMENTS

2008/0191436 A1 8/2008 Galgano et al.

OTHER PUBLICATIONS

Welcome to Quickspooler.com ((((((How the Quickspooler was invented)))))), downloaded from http://www.quickspooler.com/QS.html on Jul. 14, 2009.

Cable Pull Stands, Cable Caddy, Rope Stand, downloaded from http://cableorganizer.com/cable-pull-stands/ on Jul. 14, 2009.

Hand Caddy, Data Cable Caddy, GL-9520, Greenlee 9520, downloaded from http://cableorganizer.com/greenlee/hand-caddy/ on Jul. 14, 2009.

Cable Reel Rollers, Wire Spool Caddies & Wire Reel Carts, downloaded from http://www.wctproducts.com/cable_reel_menu.htm on Jul. 14, 2009.

Cable Spool Caddy, Wire Spool Caddy & Wire Spool Carts, downloaded from http://www.wctproducts.com/reel_caddy_page.htm on Jul. 14, 2009.

Paige 1 Pac, downloaded from http://www.paigeelectric.com/onepac.html on Jul. 14, 2009.

BELDEN/8800/Hook-Up Wire Dispenser Rack (Only / Newark.com, downloaded from http://www.newark.com/belden/8800/hook-up-wire-dispenser-rack-only/dp/20M4466 on Jul. 14, 2009.

JONARD/WD-30-Y/Wire Dispenser/Newark.com, downloaded from http://www.newark.com/jonard/wd-30/wire-dispenser/dp10F7539 on Jul. 14, 2009.

Fiber in a Box, AFL Fiber In A Box, Berktek Fiber In A Box, Wholesale Fiber Optic Cable in A . . . , downloaded from http://www.americantechsupply.com/aflfiberinabox.htm on Jul. 14, 2009.

HOTS Jun. 2003, downloaded from http://www.wireville.com/hots/hotsJune03.html on Jul. 14, 2009.

Genesis Cat5 Cable, 1000 Foot Roll in Box—WG-4978210x—SmartHomeUSA.com, downloaded from http://www.smarthomeusa.com/ShopByManufacturer/Genesis/ItemWG-4978210x/ on Jul. 14, 2009.

Fiber Reel-in-Box Cost Savings Analysis, downloaded from http://www.superioressex.com/uploadedFiles/News/Case_Studies/fiber-reel-in%20box.pdf on Jul. 17, 2009.

Carris Reels 10" Caddy, downloaded from http://www.carris.com/products/caddy10.html on Oct. 1, 2009.

Carris Reels Plastic Reels, downloaded from http://www.carris.com/plasticreels.html on Oct. 1, 2009.

Carris Reels Home Page, downloaded from http://www.carris.com/index.html on Oct. 1, 2009.

About TLE Mfg./dba Reels-USA, downloaded from http://reels-usa.com/ on Oct. 1, 2009.

* cited by examiner

TRANSPORTER FOR BOX OF SPOOLED WIRE OR CABLE

BACKGROUND OF THE INVENTION

Wire and cable for installation in residences and buildings typically comes on cable reels. The types of wire and cable so provided are numerous, including 110V three-conductor wire, "Romex", and many different kinds of low-voltage, multiconductor insulated communications cable used for setting up Ethernet networks, intercom systems, entertainment systems, and the connection of security sensors and devices. A new building under construction will need many kinds of these cables, and several reels of cable will be used by an installer on-site.

One known technique for distributing cables is to provide one or more coils of cable in a box or carton, and to create a hole in a front and/or top panel of the (typically cardboard) carton for pulling out a desired length of cable. This conventional method has the disadvantage that the cable may kink inside of the carton or otherwise resist being pulled out of the carton as it is removed from the carton. As a result, the cable installer or technician can find that he or she is pulling the carton across the floor instead of receiving the necessary length of cable. The assignee of the present invention has developed a reel-containing carton described in U.S. Patent Application Publication No. US 2008/0191436 A1, the specification and drawings of which are specifically incorporated by reference herein, that ameliorates some of these problems.

Additionally, the cartons or reels of cable are often heavy and awkward to move around the job site. Since cable is often installed in cramped or tight working conditions, transportation of reels of cable is burdensome, inefficient, and possibly even unsafe if the technician strains his or her back while moving the reels. As a result, a need exists for an efficient, convenient way to transport reels or cartons of cable around the job site.

SUMMARY OF THE INVENTION

According to one aspect of the invention, apparatus for manually transporting a carton of goods comprise a carton support structure that includes an elongate horizontal support member that extends in a first direction and has a first component and a second component affixable to the first component at any plurality of positions, such that an overall length of the horizontal support member may be adjusted. Additionally, apparatus includes a first substantially vertical support member that is affixed to the first component of the horizontal support member, a first bushing that is attached to the first vertical support member to be vertically spaced from the first component of the horizontal support member and extends from the first vertical support member in the first direction. The carton support member further comprises a second substantially vertical support member affixed to the second component of the horizontal support member, and a second bushing that is affixed to the second vertical support member to be vertically spaced from the second component of the horizontal support member. The second bushing extends in a second direction that is opposite the first direction and towards the first bushing.

Additionally, the apparatus further comprises at least one stabilization member affixed to the support structure and adapted to abut one or more surfaces of the carton to prevent the carton to prevent the carton from rotating about a horizontal axis. At least one of the first and second bushings is located on the horizontal axis. Further, a handle is affixed to the carton support structure and is spaced from the horizontal support member.

In preferred embodiments, the handle and one of the first and second vertical support members are formed as a continuous tube.

According to another aspect of the invention, a system for manually transporting a carton of goods comprises a carton having a plurality of panels, including a front panel having top, bottom, left, and right sides, a top panel extending from the top side of the front panel, a bottom panel that extends from the bottom side of the front panel, and a left panel extending from the left side of the front panel so as to be orthogonal to the bottom panel. The carton further includes a right panel that extends from the right side of the front panel so as to be parallel and spaced from the left panel, a left arbor hole formed in the left panel, and a right arbor hole formed in the right panel.

The system further includes a carton support structure that comprises an elongate horizontal support member that extends in a first direction and has a first component and a second component affixable to the first component at any of a plurality of positions, such that an overall length of the horizontal support member may be adjusted. Additionally, the carton support structure includes a first substantially vertical support member that is affixed to the first component of the horizontal support member, and a first bushing that is attached to the first vertical support member to be vertically spaced from the first component of the horizontal support member and extends from the first vertical support member in the first direction. The carton support member further a second substantially vertical support member affixed to the second component of the horizontal support member, and a second bushing that is affixed to the second vertical support member to be vertically spaced from the second component of the horizontal support member. The second bushing extends in a second direction that is opposite the first direction and towards the first bushing. The first bushing is sized to fit into the left arbor hole and the second bushing is sized to fit into the right arbor hole.

Additionally, the apparatus further comprises at least one stabilization member affixed to the carton support structure and adapted to abut one or more panels of the carton to prevent the carton to prevent the carton from rotating about a horizontal axis. At least one of the first and second bushings is located on the horizontal axis. Further, a handle is affixed to the carton support structure and is spaced from the horizontal support member.

A further system according to the invention for transporting flexible, elongated, wound material comprises a reel onto which flexible, elongated material may be wound, comprising a spindle rotatable about an axis having an exterior surface, a left spindle hole in a left end of the spindle, a right spindle hole in a right end of the spindle, and a hollow axial passage connecting the left and right spindle holes. The first bushing is sized to fit into the left spindle hole and the second bushing is sized to fit into the right spindle hole.

Further, the system comprises a reel support structure that comprises an elongate horizontal support member that extends in a first direction and has a first component and a second component affixable to the first component at any of a plurality of positions, such that an overall length of the horizontal support member may be adjusted. A first substantially vertical support member is affixed to the first component of the horizontal support member, and a first bushing is attached to the first vertical support member to be vertically spaced from the horizontal support member, extending from the first vertical support member in the first direction and being sized to fit into the left spindle hole.

The reel support structure further comprises a second substantially vertical support member affixed to the second component of the horizontal support member and a second bushing that is affixed to the second vertical support member to be vertically spaced from the horizontal support member. The second bushing extends in a second direction that is opposite the first direction and towards the first bushing, together with the first bushing forming the axis. The spindle is rotatable about the axis and a handle is affixed to the carton support structure being spaced from the horizontal support member.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
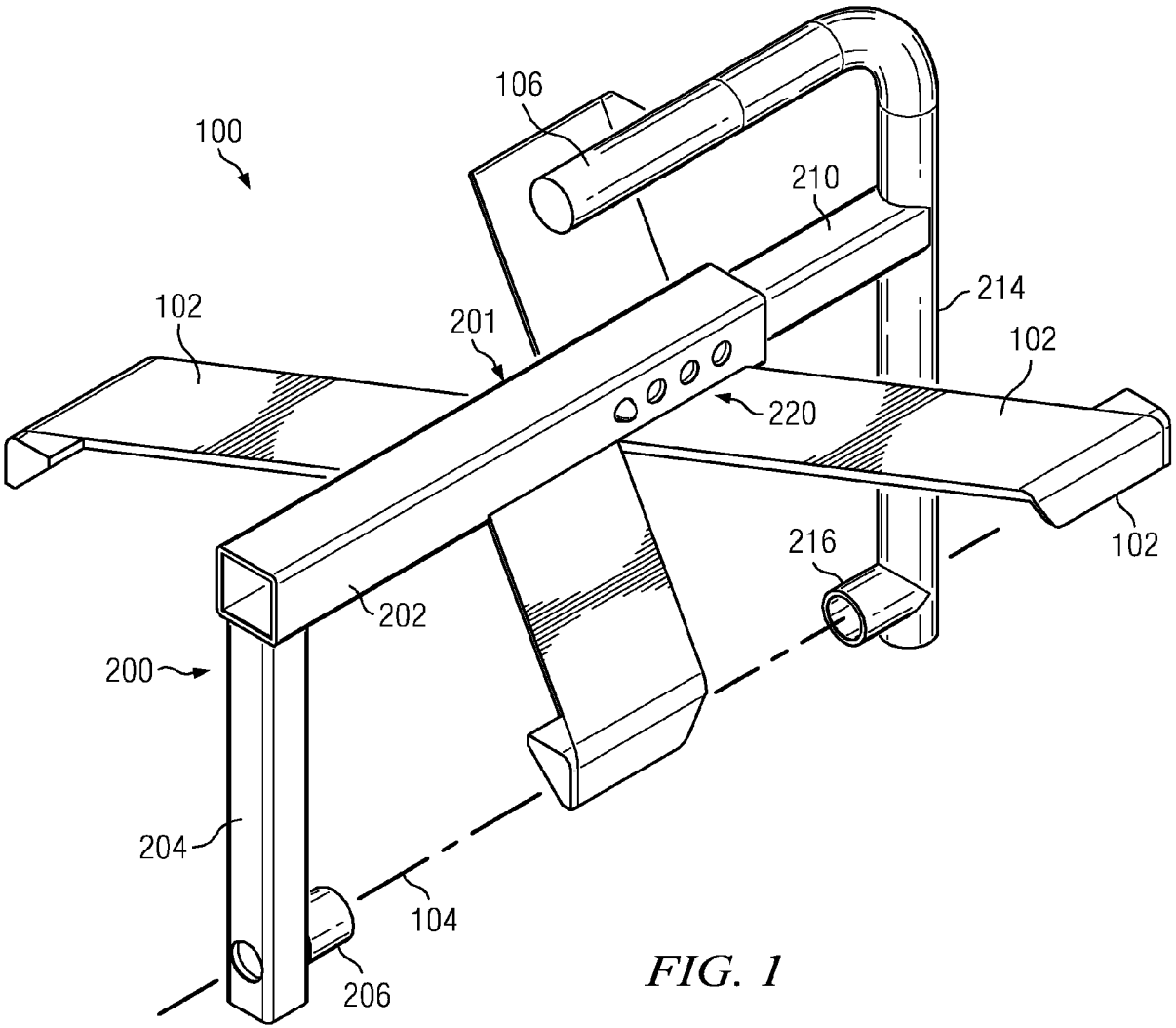
FIG. 1 is an isometric view showing a first embodiment of the invention's apparatus for transporting a carton of goods.
Figures 2, 2A, 2B:
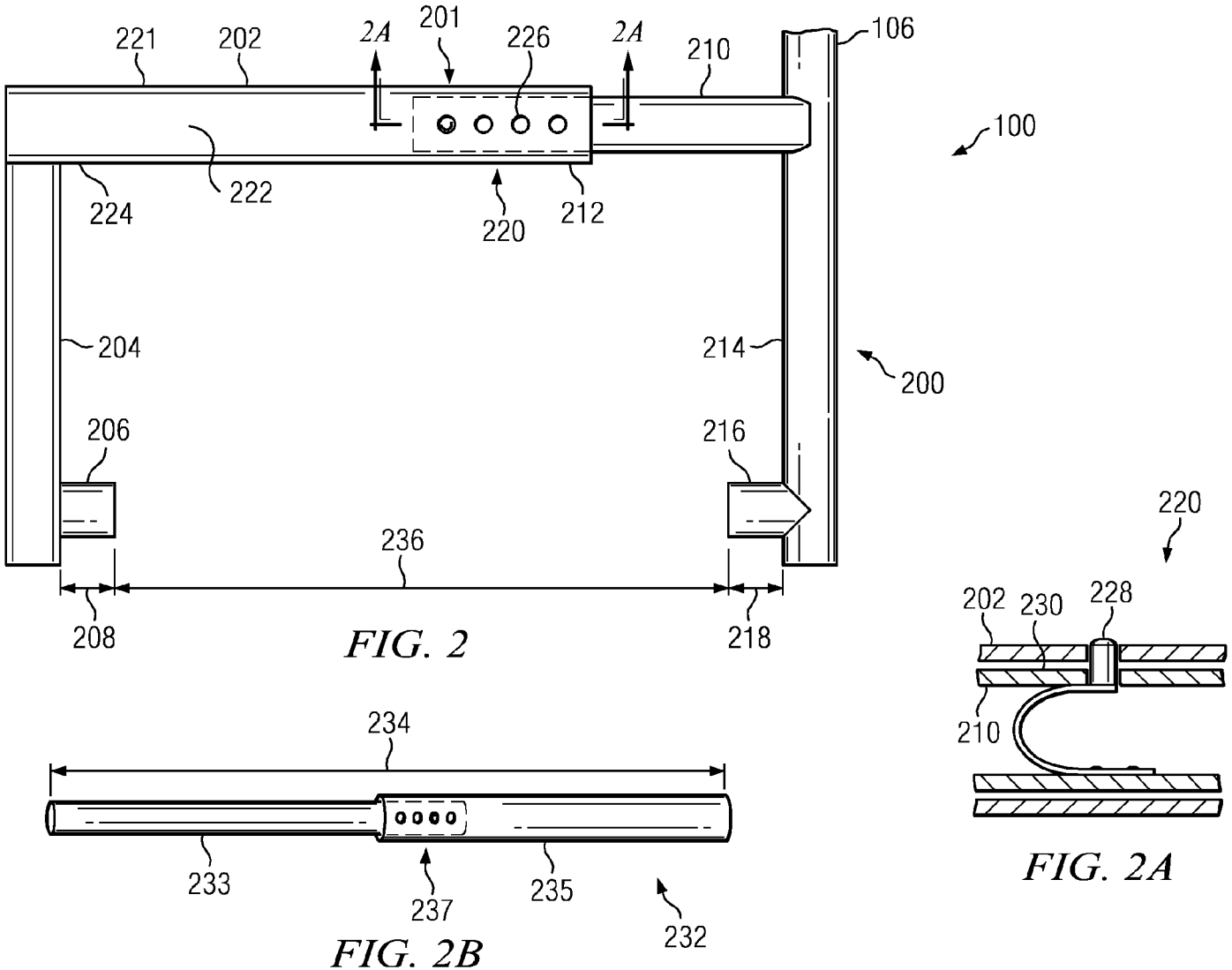
FIG. 2 is a schematic elevational view showing the carton support structure according to the embodiment of FIG. 1.
FIG. 2A is a section detail taken substantially along line 2A-2A of FIG. 2.
FIG. 2B is a view of an axial support member for use with the embodiment shown in FIGS. 1-2A.

Referring to FIGS. 1 and 2, apparatus, indicated generally at 100, for manually transporting a carton of goods comprise a carton support structure 200 that includes an elongate horizontal support member 201 extending in a first direction and having a first component 202 and a second component 210 affixable to the first component 202 at any of a plurality of positions, such that an overall length of the horizontal support member 201 may be adjusted.

Additionally, a first substantially vertical support member 204 is affixed to the first component 202 of the horizontal support member 201, and a first bushing 206 is attached to the first vertical support member 204 to be vertically spaced from the first component 202 of the horizontal support member 201 by a distance which is somewhat larger than the radius of a reel of goods to be transported. The first bushing 206 extends from the first vertical support member 204 a first predetermined distance 208 in the first direction. The carton support structure 200 further comprises a second substantially vertical support member 214 affixed to the second component 210 of the horizontal support member 201, and a second bushing 216 that is affixed to the second vertical support member 214 to be vertically spaced from the second component 210 of the horizontal support member 201. The second bushing 216 extends from the second vertical support member 214, a second predetermined distance 218 in a second direction that is opposite the first direction and towards the first bushing 206. The two components 202, 210 of the horizontal support member 201 can take other configurations such as two plates bolted to one another, a first tube which is slidably inserted into a second tube, or possibly a blade fitting into a channel.

Figure 3:
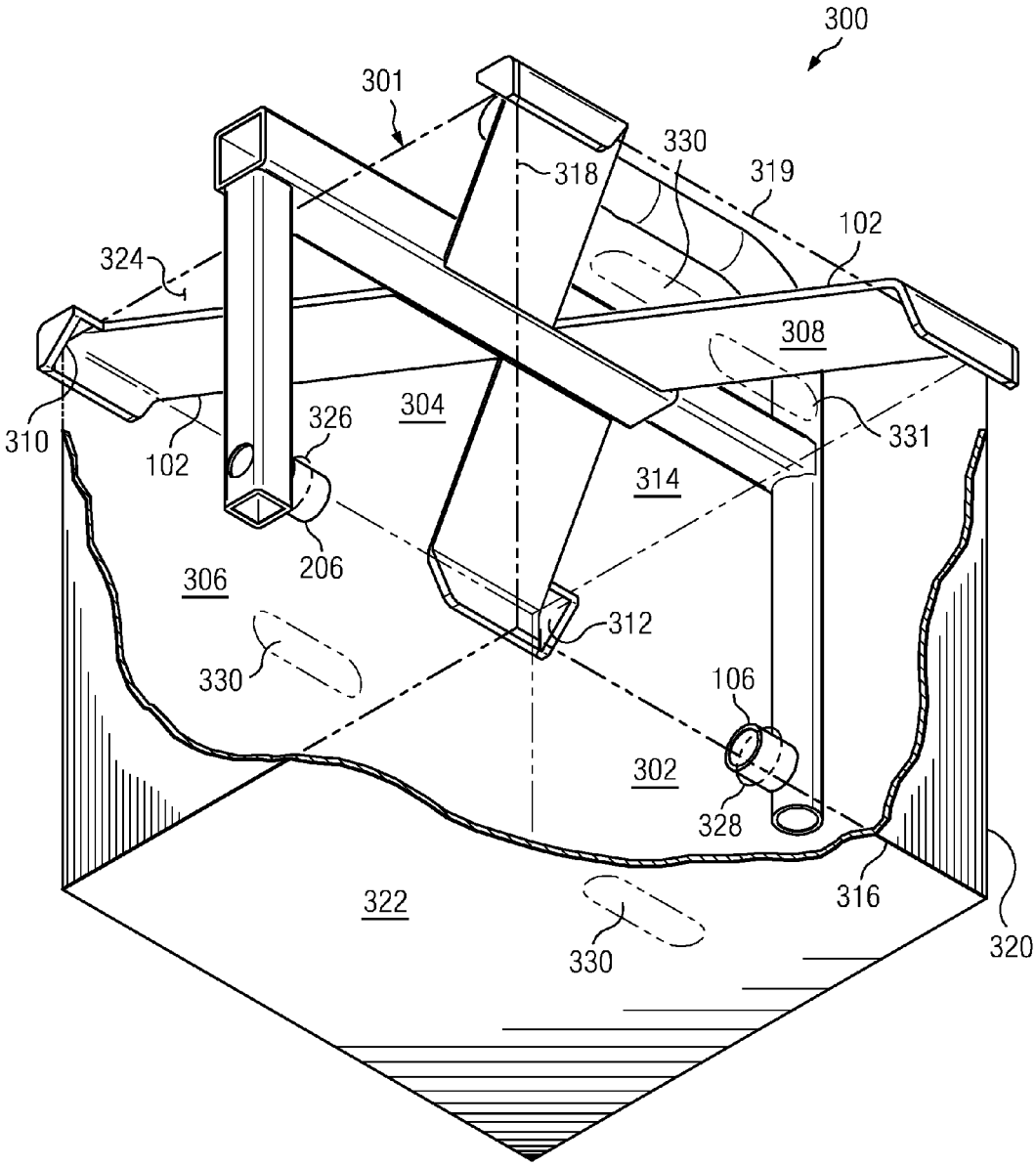
FIG. 3 is an isometric drawing of another embodiment of the invention showing a system for manually transporting goods, a transported carton being shown in dotted line.

The apparatus 100 further comprises at least one stabilization member 102 affixed to the carton support structure 200, preferably at the first component 202 of the horizontal support member 201, and adapted to abut one or more nonrotational surfaces 304 of the carton 301 to prevent the carton 301 from rotating about a horizontal axis 104 (see FIG. 3). At least one and preferably both of the first and second bushings 206, 216 is located on the horizontal axis 104. Further, a handle 106 is affixed to the carton support structure 200 and a horizontal length of it is spaced from the horizontal support member 201. In a preferred embodiment, the handle 106 and one of the first and second vertical support members 204, 214 are formed as a continuous tube. Alternatively, the handle 106 can be attached to the either the first or second components 202, 210 of the horizontal support member 201. Preferably, the handle 106 is at least as long as the first component 202 of the horizontal support member 201, but it may be longer or shorter than this to increase user comfort.

As can be seen in FIG. 2 and FIG. 2A, the apparatus 100 may also include a releasable latch 220 for fixing in place the first component 202 of the horizontal support member 201 relative to the second component 210 of the horizontal support member 201. Preferably, the first component 202 of the horizontal support member 201 comprises a hollow tube 221 that is defined by a sidewall 222, a right end 212, and a left end 224 and has one and preferably several openings 226 in the sidewall 222. A detent 228 upstanding from an exterior sidewall 230 of the second component 210 of the horizontal support member 201, acts as the releasable latch 220. The detent 228 is sized and positioned to fit into one or more of the openings 226 in the first component 202 of the horizontal support member 201 when a distance 236 between the first bushing 206 and the second bushing 216 equals one or more predetermined lengths. More preferably, the first component 202 of the horizontal support member 201 comprises a plurality of openings 226 spaced apart from each other in the first direction such that the distance 236 between the first bushing 206 and the second bushing 216 is adjustable to accommodate cartons 301 of different lengths, each such length being equal to bushing lengths 208, 218 plus their separation 236.

Referring to FIG. 3, the stabilization member 102 generally conforms to at least one nonrotational surface 304, and preferably two surfaces 304, 314 of the carton 301. The stabilization member 102 has a first surface 308 that conforms to the horizontal top surface 304 of the carton 301, a second surface 310 conforming to a first vertical surface 324 of the carton 301, and a third surface 312 conforming to a second vertical surface 302 of the carton 301 spaced from the first vertical surface 324 of the carton 301.

Referring to FIG. 2B, the apparatus 100 may further comprise an axial support member 232 for attachment to the first bushing 206 and the second bushing 216 and having a predetermined length 234. The axial support 232 member may be a hollow tube or a solid rod and be slidably received into the first and second bushings 206, 216. More preferably, the axial support member 232 may further include a first axial section 233 and a second axial section 235 and a second releasable latch 237, as above, for fixing in place the first axial support member 232 relative to the second axial section 235.

Referring to FIGS. 2 and 3, a complete system for manually transporting a carton of goods, indicated generally at 300, comprises a carton 301 that includes a front panel 314 having top side 319, a bottom side 316, left side 318, and right side 320, a top panel 304 extending from the top side of the front panel, a bottom panel 322 extending from the bottom side 316 of the front panel 314, a left panel 324 extending from the left side 318 of the front panel 314 so as to be orthogonal to the bottom panel 322, and a right panel 302 extending from the right side 320 of the front panel 314 so as to be parallel and spaced from the left panel 324. The carton 301 further comprises a left arbor hole 326 in the left panel 324 and a right arbor hole 328 in the right panel 302. While the illustrated carton 301 is a conventional box built as a right prism on a rectangular base, it may be other shapes. It is preferred that the carton 301 have at least one nonrotational surface with the stabilization member 102 can intersect to prevent rotation of the carton 301 around axis 104.

Figure 4:
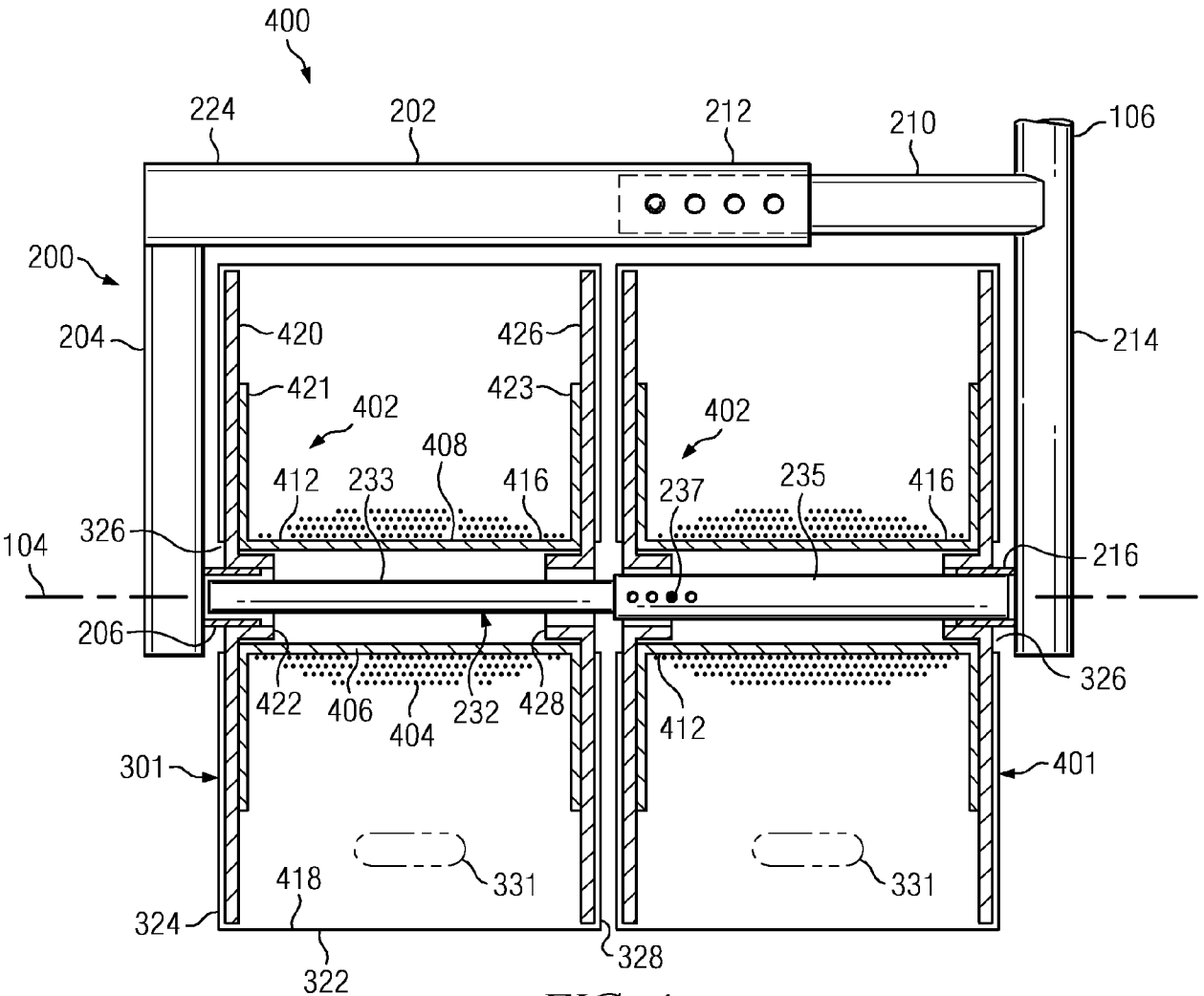
FIG. 4 is a sectional view of another embodiment of the invention showing a system for transporting flexible, elongated, wound material.
Figure 4A:
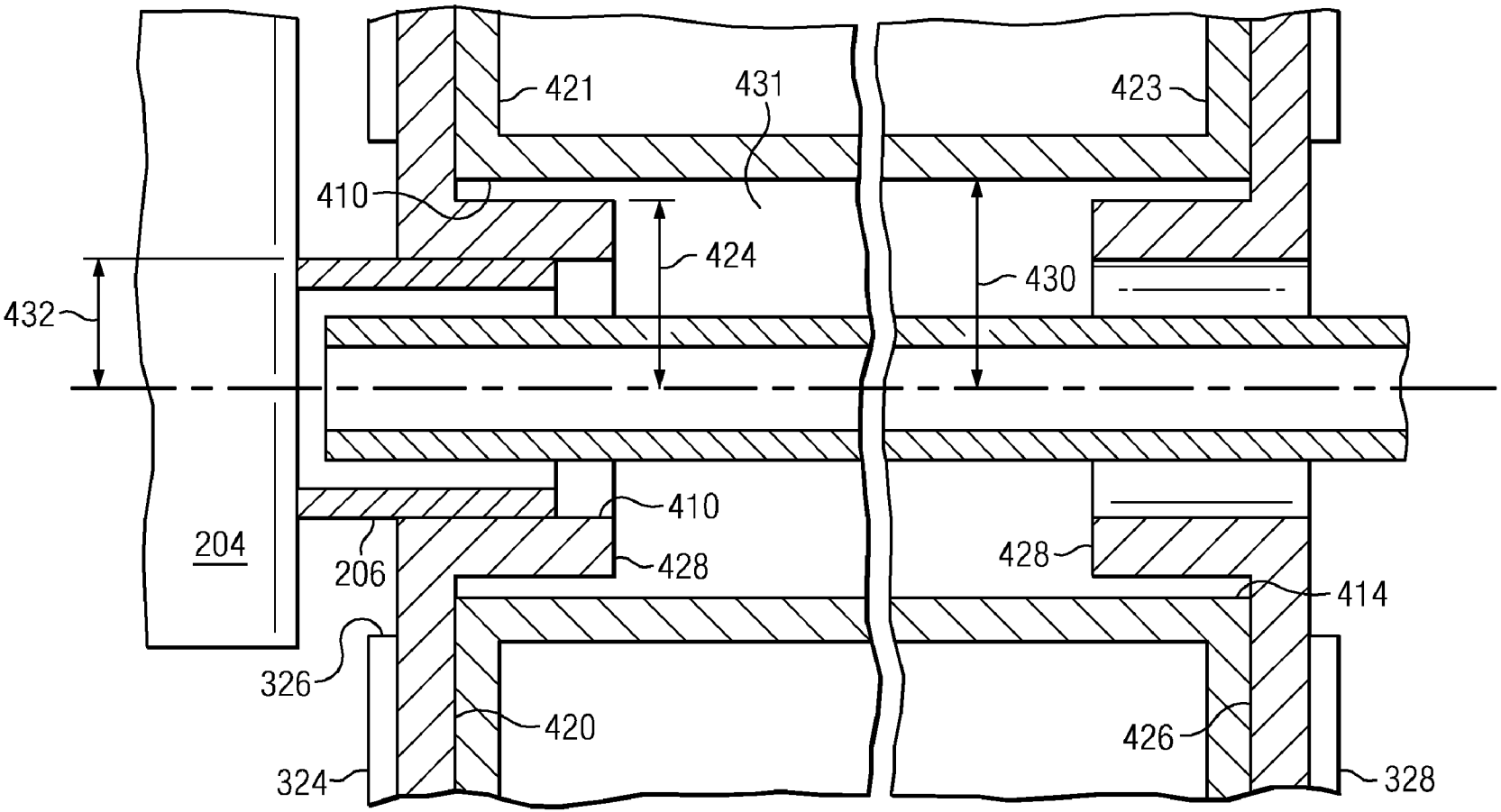
FIG. 4A is a sectional detail of FIG. 4.

The system 300 further comprises the carton support structure 200, the stabilization member or members 102, handle 106, releasable latch 220, axial support member 232 as described above. As can be seen in FIGS. 4 and 4A, the system 300 may include a plurality of cartons 301, 401 that are supported by the axial support member 232 (shown as first and second axial sections 233, 235) inserted into the left and right arbor holes 326, 328 and the first and second bushings 206, 216. Additionally, the system can comprise a dispensing slot or feed hole 331 in the front panel 314, top panel 304, or bottom panel 322 from which the elongated flexible material 404 (which will typically be, but is not limited to, insulated electrical cable) is pulled.

Referring again to FIG. 3, the cartons 301 preferably have one or more pass-through openings 330 in the top panel 304, front panel 314, and the bottom panel 322. In operation, the stabilization member 102 prevents the cartons 301 from rotating as the cartons' contents, typically flexible, elongated material such as wire, rope, string, textiles, paper, and plastic, are removed through the dispensing slot 331.

In another embodiment of the invention, shown in FIGS. 4 and 4A, a system for transporting flexible, elongated, wound material, preferably rope string, cable, textiles, paper, or plastic, comprises a reel 402 onto which flexible, elongated material 404 may be wound. The reel 402 comprises a spindle 406 that is rotatable about an axis 104, the spindle 406 having an exterior surface 408, a left spindle hole 410 in a left end 412 of the spindle 406, a right spindle hole 414 in the right end 416 of the spindle 406, and a hollow axial passage 431 connecting the left and right spindle holes 414, 410. Additionally, the left end 412 of the spindle 406 may further comprise a left flange 421 and the right end 416 may further comprise a right flange 423.

The system further comprises the handle 106 and the reel support structure 200 described above. Additionally, the system may include a reel-enclosing carton 301 (described above) and may further comprise a left caddy 420 disposed in the carton 301 to be adjacent to the left panel 324 and to extend upwardly from the upper surface 418 of the bottom panel 322. A substantially cylindrical left caddy bushing 422 extends inwardly from the left caddy 420 toward the right panel 302 and is formed around the axis 104 at a first axial radius 424.

Similarly, a right caddy 426 is disposed in the carton 301 to be adjacent to the right panel 302 and to extend upwardly from the upper surface 418 of the bottom panel 322. A substantially cylindrical right caddy bushing 428 extends inwardly toward the left panel 324 and is formed to be substantially at the first axial radius 424 from the axis 104. The left and right spindle holes 410, 414 are formed at a second axial radius 430 that is larger than the first axial radius 424. The first and second bushings 206, 216 affixed to the vertical support members 204, 214 are formed at a third axial radius 432 that is smaller than the first axial radius 424. Thus, the left and right caddy bushings 422, 428 fit into the left and right spindle holes 410, 414 and the first and second bushings 206, 216 affixed to the vertical support members 204, 214 fit through the left and right arbor holes 326, 328 and into the left and right caddy bushings 422, 428. Finally, an axial support member 232 may be disposed inside the first and second bushings 206, 216 affixed to the vertical support members 204, 214.

In summary, the different embodiments of the invention show that it may be used in a wide variety of applications and will increase the portability of any carton or reel having arbor holes. Also, the different embodiments of the invention will save significant amounts of time at worksites, thereby reducing costs, and improve handling of these cumbersome objects, thereby increasing worker safety.

While illustrated embodiments of the present invention have been described and illustrated in the appended drawings, the present invention is not limited thereto but only by the scope and spirit of the appended claims.

The invention claimed is:

1. Apparatus for manually transporting a carton of goods, comprising:

a carton support structure comprising:

an elongate horizontal support member extending in a first direction and having a first component and a second component affixable to the first component at any of a plurality of positions, such that an overall length of the horizontal support member may be adjusted;

a first substantially vertical support member affixed to the first component of the horizontal support member;

a first bushing attached to the first vertical support member to be vertically spaced from the first component of the horizontal support member and extending from the first vertical support member in the first direction;

a second substantially vertical support member affixed to the second component of the horizontal support member;

a second bushing affixed to the second vertical support member to be spaced vertically from the second component of the horizontal support member and extending in a second direction opposite the first direction and toward the first bushing;

at least one stabilization member affixed to the carton support structure and adapted to abut at least one nonrotational surface of a carton to prevent the carton from rotating about a horizontal axis on which is located at least one of the first and second bushings; and a handle affixed to the carton support structure and being spaced from the horizontal support member.

2. The apparatus of claim 1, wherein the handle and one of the first and second vertical support members are formed as a continuous tube.

3. The apparatus of claim 1, further comprising a releasable latch for fixing in place the first component of the horizontal support member relative to the second component of the horizontal support member.

4. The apparatus of claim 3, wherein the first component of the horizontal support member comprises a hollow tube defined by a sidewall, a right end, and a left end, and having at least one opening in the sidewall at a first predetermined location; and a detent upstanding from an exterior sidewall of the second component of the horizontal support member at a second predetermined location as the releasable latch;

wherein the detent is sized and positioned to fit into the at least one opening in the first component of the horizontal support member when a distance between the first bushing and second bushing equals at least one predetermined length.

5. The apparatus of claim 4, wherein the first component of the horizontal support member comprises a plurality of openings spaced apart from each other in the first direction such that the distance between the first bushing and second bushing is adjustable to accommodate cartons having different lengths.

6. The apparatus of claim 1, wherein the stabilization member is affixed to the first component of the horizontal support member.

7. The apparatus of claim 1, wherein the stabilization member conforms to at least two nonrotational surfaces of the carton.

8. The apparatus of claim 1, wherein the stabilization member has a first surface conforming to a horizontal top surface of the carton, a second surface conforming to a first vertical surface of the carton, and a third surface conforming to a second vertical surface of the carton spaced from the first vertical surface of the carton.

9. The apparatus of claim 1, further comprising an axial support member for attachment to the first bushing and the second bushing.

10. The apparatus of claim 9, wherein the axial support member is a hollow tube, the first and second bushing being hollow, the axial support member slidably received into the first and second bushings.

11. A system for manually transporting a carton of goods, comprising:

a carton comprising a plurality of panels including a front panel having top, bottom, left and right sides, a top panel extending from the top side of the front panel, a bottom panel extending from the bottom side of the front panel, a left panel extending from the left side of the front panel so as to be orthogonal to the bottom panel, and a right panel extending from the right side of the front panel so as to be parallel and spaced from the left panel;

a left arbor hole formed in the left panel;

a right arbor hole formed in the right panel;

a carton support structure comprising an elongate horizontal support member extending in a first direction and having a first component and a second component affixable to the first component at any of a plurality of positions, such that an overall length of the horizontal support member may be adjusted;

a first substantially vertical support member affixed to the first component of the horizontal support member;

a first bushing attached to the first vertical support member to be vertically spaced from the first component of the horizontal support member, extending from the first vertical support member in the first direction;

a second substantially vertical support member affixed to the second component of the horizontal support member;

a second bushing affixed to the second vertical support member to be vertically spaced from the second component of the horizontal support member, extending in a second direction opposite the first direction and toward the first bushing;

at least one stabilization member affixed to the carton support structure and adapted to abut at least one panel of the carton to prevent the carton from rotating about a horizontal axis, on which is located at least one of the first and second bushings; and a handle affixed to the carton support structure and being spaced from the horizontal support member.

12. The system of claim 11, wherein the stabilization member has a first surface conforming to a horizontal first surface of the carton, a second surface conforming to a first vertical surface of the carton, and a third surface conforming to a second vertical surface of the carton spaced from the first vertical surface of the carton.

13. The system of claim 11, further comprising a releasable latch for affixing the first component of the horizontal support member relative to the second component of the horizontal support member.

14. The system of claim 13, wherein the first component of the horizontal support member comprises a hollow tube defined by a sidewall, a right end, and a left end, and having at least one opening in the in the sidewall at a first predetermined location; and a detent upstanding from an exterior sidewall of the second component of the horizontal support member at a second predetermined location as the releasable latch;

wherein the detent is sized and positioned to fit into the at least one opening in the first component of the horizontal support member when a distance between the first bushing and second bushing equals at least one predetermined length.

15. The system of claim 11, further comprising an axial support member for attachment to the first bushing and the second bushing.

16. The system of claim 15, wherein the first component of the horizontal support member comprises a plurality of openings spaced apart from each other in the first direction such that the distance between the first bushing and the second bushing is adjustable to accommodate cartons having different lengths.

17. The system of claim 15, further comprising a plurality of cartons having top panels, front panels, left panels, right panels, left arbor holes, and right arbor holes, and being supported by the axial support member inserted into the left and right arbor holes.

18. The system of claim 11, further comprising a pass-through opening in at least one of the front, top, and bottom panels for removal of elongate, flexible goods from the carton.

19. The system of claim 11, wherein the stabilization member prevents the carton from rotating around the arbor holes as carton contents are removed through a dispensing slot.

20. The system of claim 19, wherein the carton contents are flexible, elongated material.

21. A system for transporting flexible, elongated, wound material, comprising:

at least one carton containing a reel onto which flexible, elongated material may be wound, comprising a spindle rotatable about an axis, the spindle having an exterior surface, a left spindle hole in a left end of the spindle, and a right spindle hole in a right end of the spindle, a hollow axial passage connecting the left and right spindle holes;

a reel support structure comprising an elongate horizontal support member extending in a first direction and having a first component and a second component affixable to the first component at any of a plurality of positions, such that an overall length of the horizontal support member may be adjusted;

a first substantially vertical support member affixed to the first component of the horizontal support member;

a first bushing attached to the first vertical support member to be vertically spaced from the horizontal support member, extending from the first vertical support member in the first direction, and being sized to fit into the left spindle hole;

a second substantially vertical support member affixed to the second component of the horizontal support member;

a second bushing affixed to the second vertical support member to be vertically spaced from the horizontal support member, extending in a second direction opposite the first direction and extending toward the first bushing, together with the first bushing forming the axis, and being sized to fit into the right spindle hole; at least one stabilization member affixed to the reel support structure and adapted to abut at least one nonrotational surface of the at least one carton to prevent the at least one carton from rotating about a horizontal axis on which is located at least one of the first and second bushing; and a handle affixed to the reel support structure and being spaced from the horizontal support member.

22. The system of claim 21, wherein the material is selected from the group consisting of wire, rope, string, cable, textiles, paper, and plastic.

23. The system of claim 21, further comprising the at least one carton comprising a plurality of panels including a front panel having top, bottom, left and right sides, a top panel extending from the top side of the front panel, a bottom panel having an upper surface and extending from the bottom side of the front panel, a left panel extending from the left side of the front panel so as to be orthogonal to the bottom panel, and a right panel extending from the right side of the front panel so as to be parallel and spaced from the left panel;

a left arbor hole formed in the left panel;

a right arbor hole formed in the right panel;

a dispensing slot formed in at least one panel;

a left caddy disposed in the carton to be adjacent the left panel and to extend upwardly from the upper surface of the bottom panel, a substantially cylindrical left caddy bushing extending inwardly toward the right panel, the left caddy bushing formed around the axis at a first axial radius from the axis;

a right caddy disposed in the carton to be adjacent the right panel and to extend upwardly from the upper surface of the bottom panel, a substantially cylindrical right caddy bushing extending inwardly toward the left panel, the right caddy bushing formed substantially at the first axial radius from the axis;

wherein the left and right spindle holes are formed at a second axial radius from the axis being larger than the first axial radius, the first and second bushings affixed to the vertical support members being formed at a third axial radius smaller than the first axial radius, such that the left and right caddy bushings fit into the left and right spindle holes, and the first and second bushings affixed to the vertical support members fit through the left and right arbor holes and into the left and right caddy bushings.

24. The system of claim 23, further comprising an axial support member disposed inside the first and second bushings affixed to the vertical support members.

* * * * *